US006910656B2

(12) United States Patent
Lysiak et al.

(10) Patent No.: US 6,910,656 B2
(45) Date of Patent: Jun. 28, 2005

(54) INK RIBBON CARTRIDGE WITH LEAF SPRING AND METHOD OF ASSEMBLING THE SAME

(75) Inventors: Paul A. Lysiak, Rochester, NY (US); Hiroshi Sato, Morioka (JP)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/370,921

(22) Filed: Feb. 20, 2003

(65) Prior Publication Data

US 2004/0164201 A1 Aug. 26, 2004

(51) Int. Cl.[7] ..... B41J 35/28

(52) U.S. Cl. ..... 242/598.3; 242/345.2; 242/598.4; 400/207; 267/163

(58) Field of Search ..... 242/598.3, 598.4, 242/345.2, 347, 348.4; 400/207, 242, 243; 267/158, 163

(56) References Cited

U.S. PATENT DOCUMENTS

| | | | | |
|---|---|---|---|---|
| 3,934,835 A | * | 1/1976 | Maxwell | 242/535.5 |
| 4,179,077 A | * | 12/1979 | Morishita | 242/423 |
| 4,629,144 A | * | 12/1986 | Schoettle | 242/345.2 |
| 4,662,579 A | | 5/1987 | Gelardi et al. | |
| 4,781,340 A | | 11/1988 | Shiba et al. | |
| 4,883,234 A | | 11/1989 | Yamakawa et al. | |
| 4,899,243 A | | 2/1990 | Bordignon | |
| 5,094,434 A | | 3/1992 | Ryu | |
| 5,110,228 A | | 5/1992 | Yokomizo | |
| 5,195,696 A | * | 3/1993 | Kee Dong | 242/345.2 |
| 5,492,422 A | | 2/1996 | Kondo | |
| 5,667,318 A | | 9/1997 | Tanno et al. | |
| 5,865,545 A | * | 2/1999 | Kondo | 400/207 |
| 6,195,111 B1 | * | 2/2001 | Nelson et al. | 347/214 |

FOREIGN PATENT DOCUMENTS

| | | |
|---|---|---|
| EP | 0 638 434 | 2/1995 |
| JP | 07-047732 | 2/1995 |
| JP | 10-337923 | 12/1998 |
| JP | 11-342654 | 12/1999 |
| WO | WO 98/04415 | 2/1998 |
| WO | WO 99/44834 | 9/1999 |

* cited by examiner

*Primary Examiner*—Kathy Matecki
*Assistant Examiner*—Sang Kim
(74) *Attorney, Agent, or Firm*—Roger A. Fields

(57) ABSTRACT

A method of assembling an ink ribbon cartridge comprises inserting a leaf spring having a mounting frame and a flat spring finger that longitudinally extends from the mounting frame, beginning at an opening in the mounting frame, and at an acute angle from the opening, into a housing-half to position the spring finger pointing at the acute angle into the housing-half, and inserting an ink ribbon spool having opposite hub ends and a rotation axis into the housing-half, laterally relative to the rotation axis, to cause one of the hub ends to depress the spring finger at least partially into the opening, whereby the spring finger will urge the spool in one direction along the rotation axis.

11 Claims, 2 Drawing Sheets

INK RIBBON CARTRIDGE WITH LEAF SPRING AND METHOD OF ASSEMBLING THE SAME

FIELD OF THE INVENTION

The invention relates generally to an ink ribbon cartridge such as may be used in a thermal printer and to a method of assembling the same, and in particular to an ink ribbon cartridge that has a leaf spring for biasing an ink ribbon spool axially to deter accidental rotation of the spool in the cartridge.

BACKGROUND OF THE INVENTION

Ink ribbon cartridges for a thermal printer are well known. Typically, the ink ribbon cartridge includes an ink ribbon supply spool and an ink ribbon take-up spool that are rotationally supported parallel to one another in a cartridge housing. The ink ribbon has a repeating series of three different color sections or patches such as a yellow color patch, a magenta color patch, and a cyan color patch. Also, there may be a transparent colorless laminating section or patch immediately after each cyan color patch.

Often, a compression-type spring is interposed between an inner wall at one side of the cartridge housing and one hub end of each spool. The spring urges a spool in one direction along the rotation axis of the spool, to force the opposite hub end of the spool against an inner wall at another side of the cartridge housing. This is done to prevent the spool from being rotated accidentally, such as might occur when the cartridge is jarred, which could cause the ink ribbon to partially unwind from the spool and slacken.

During cartridge assembly in prior art U.S. Pat. No. 4,883,234 issued Nov. 28, 1989 a u-shaped leaf spring is rotationally engaged with one hub end of a spool. The spool, engaged with the leaf spring, is inserted laterally into a housing-half to position the leaf spring against an inner wall at one side of the housing-half. The leaf spring then urges the opposite hub end of the spool against an inner wall at another side of the housing-half.

During cartridge assembly in prior art U.S. Pat. No. 5,110,228 issued May 5, 1992 a spool is inserted laterally into a housing-half to position one hub end of the spool against a resilient member projecting integrally from an inner wall at one side of the housing-half. The resilient member urges an opposite end of the spool against a rotation stopper on an inner wall at another side of the housing-half.

SUMMARY OF THE INVENTION

According to one aspect of the invention, an ink ribbon cartridge comprising an ink ribbon spool having opposite hub ends and a rotation axis, a housing-half into which the spool is inserted laterally relative to the rotation axis during cartridge assembly, and a leaf spring that presses against one of the hub ends of said spool to urge the spool in one direction along the rotation axis in the housing-half, is characterized in that:

the leaf spring has a mounting frame and a flat spring finger that longitudinally extends from the mounting frame, beginning at an opening in the mounting frame, and at an acute angle from the opening, in order to be depressed at least partially into the opening by the one hub end when the spool is laterally inserted into the housing-half, whereby the spring finger will urge the spool in one direction along the rotation axis.

According to another aspect of the invention, a method of assembling an ink ribbon cartridge comprises:

inserting a leaf spring having a mounting frame and a flat spring finger that longitudinally extends from the mounting frame, beginning at an opening in the mounting frame, and at an acute angle from the opening, into a housing-half to position the spring finger pointing at the acute angle into the housing-half; and inserting an ink ribbon spool having opposite hub ends and a rotation axis into the housing-half, laterally relative to the rotation axis, to cause one of the hub ends to depress the spring finger at least partially into the opening, whereby the spring finger will urge the spool in one direction along the rotation axis.

DETAILED DESCRIPTION OF THE INVENTION

Because the features of an ink ribbon cartridge such as may be used in a thermal printer are generally known, the description which follows is directed in particular only to those elements forming part of or cooperating with the invention. It is to be understood, however, that other elements not disclosed may take various forms known to persons of ordinary skill in the art.

Figure 1:
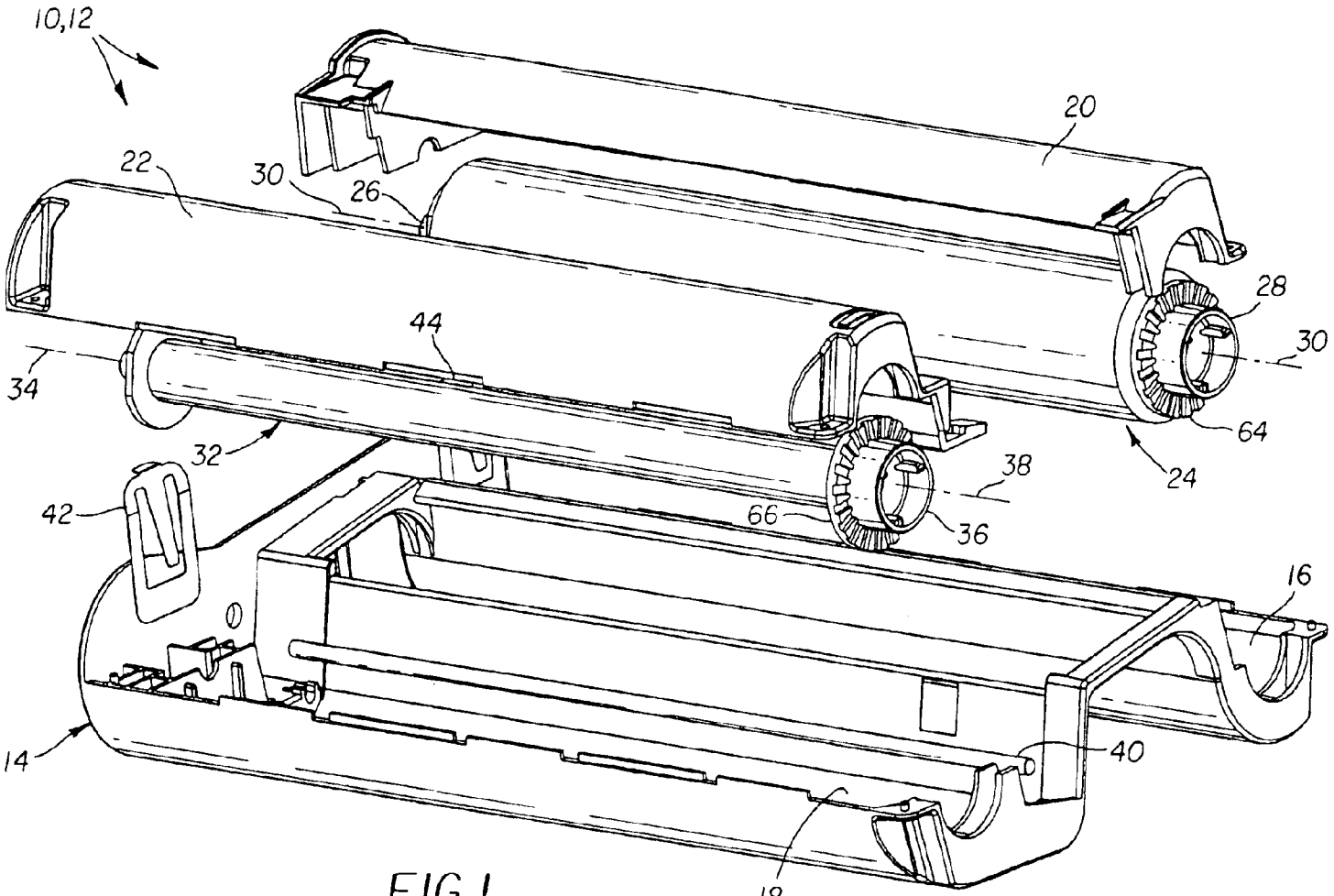
FIG. 1 is an exploded perspective view of an ink ribbon cartridge with a leaf spring according to a preferred embodiment of the invention.

FIG. 1 shows an ink ribbon cartridge 10 having a (plastic) cartridge shell or housing 12 that comprises a housing-half 14, which includes parallel semi-cylindrical chambers 16 and 18, and also respective semi-cylindrical covers 20 and 22 for the two chambers. An ink ribbon supply (plastic) spool 24 having opposite hub ends 26 and 28 and an axis of rotation 30 resides in the chamber 16, and an ink ribbon take-up (plastic) spool 32 having opposite hub ends 34 and 36 and an axis of rotation 38 resides in the chamber 18. The ink ribbon supply and take-up spool 24 and 32 are essentially identical, and are intended to be unwindingly and windingly rotated in the same direction, i.e. clockwise in FIG. 1, to advance an ink ribbon (not shown) from one spool to the other spool and over an intermediate ribbon tensioning (stainless steel) shaft 40 proximate the chamber 18. The ink ribbon has a repeating series of three different color sections or patches such as a yellow color patch, a magenta color patch, and a cyan color patch. Also, there may be a transparent colorless laminating section or patch immediately after each cyan color patch.

Figure 2:
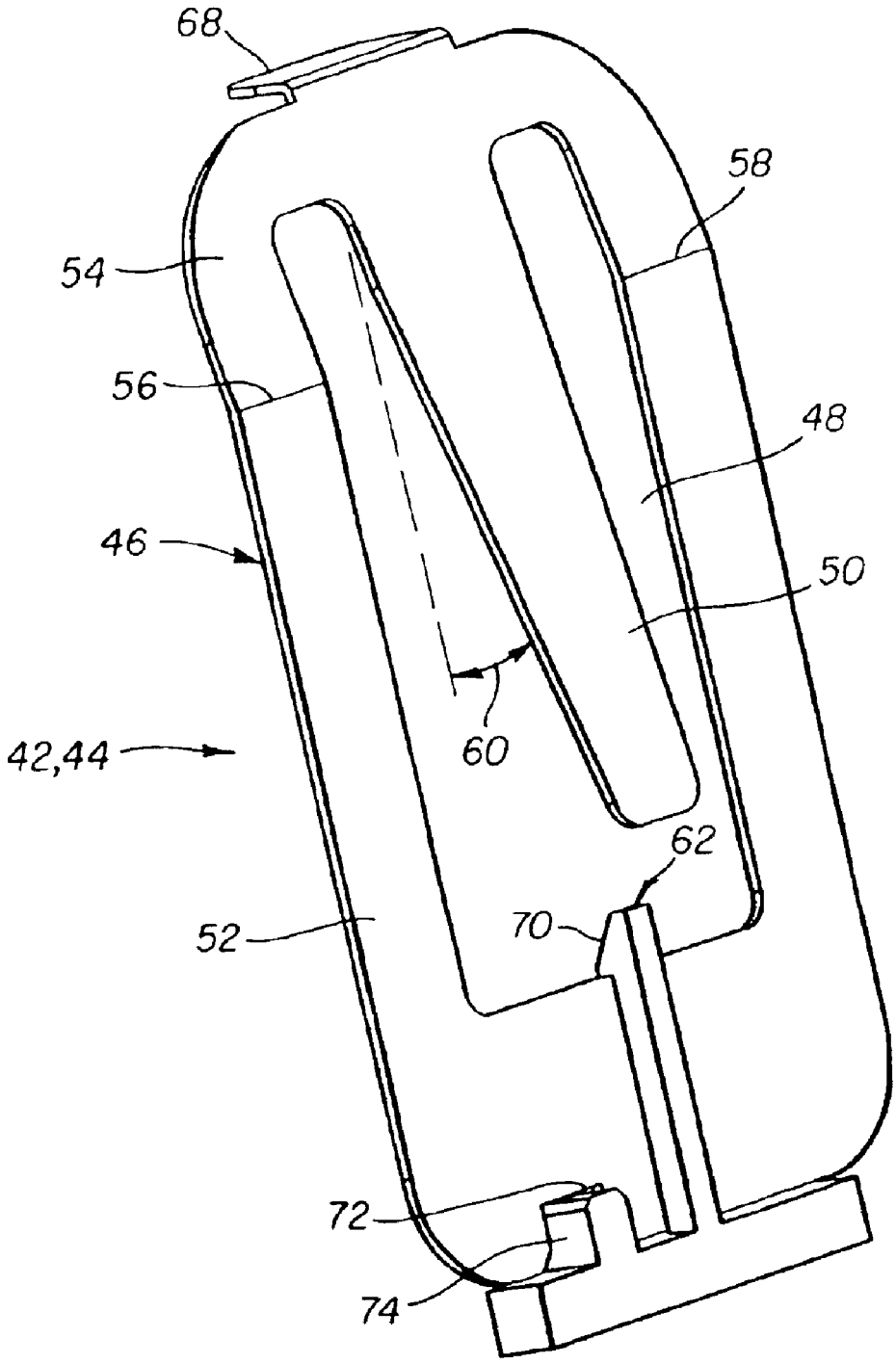
FIG. 2 is an enlarged perspective view of the leaf spring.

As shown in FIGS. 1 and 2, two leaf springs 42 and 44 are identical and each one comprises a rectangular-shape thin mounting frame 46 that has a similar shape opening 48 and a flat spring finger 50. Each one of the mounting frames 46, 46 of the leaf springs 42 and 44 is divided into a major-size portion 52 and a minor-size portion 54 which is slightly bent from the major portion at creases 56 and 58. The spring fingers 50, 50 longitudinally extend from the minor portions 54, 54, beginning at the openings 48, 48, and at acute angles 60, 60 from the openings, and they taper away from the minor portions. The acute angles 60, 60 are less than 45°, and preferably are 12.4°.

The mounting frames 46, 46 of the leaf springs 42 and 44 are intended to be supported erect in the housing-half 14 as shown in FIG. 1, with the spring fingers 50, 50 pointing at the acute angles 60, 60 into the housing-half. Two hooks 62, 62 on the housing-half 14, proximate the chambers 16 and 18, project into the openings 48, 48 of the mounting frames 46, 46 to engage the major portions 52, 52 of the mounting frames in order to secure the mounting frames in the housing-half. See FIG. 2.

The hub ends 26 and 34 of the ink ribbon supply and take-up spools 24 and 32 depress the spring fingers 50, 50 at least partially into the openings 48, 48 of the frames 46, 46 when the spools are in the chambers 16 and 18. As a result, the spools 24 and 32 are urged by the spring fingers 50, 50 in one direction along their axes of rotation 30 and 38, i.e. generally to the right in FIG. 1. Respective ribs (not shown) on the housing-half 14, project into the chambers 16 and 18 to engage toothed flanges 64 and 66 of the spools 24 and 32 to prevent accidental rotation of the spools. To rotate the spools 24 and 32, they must first be slightly pushed to the left in FIG. 1 at their hub ends 28 and 36 to disengage the flanges 58 and 60 from the ribs.

Assembly Method

The leaf springs 42 and 44 and the ink ribbon supply and take-up spools 24 and 32 are assembled in the housing-half 14 as follows.

The leaf springs 42 and 44 are manually inserted into the housing-half 14 as shown in FIG. 1 by being manually pushed down at push tabs 68, 68 on the minor portions 54, 54 of the mounting frames 46, 46. See FIG. 2. The mounting frames 46, 46 are flexed over ramp-like surfaces 70, 70 of the hooks 62, 62 on the housing-half 14 and come to rest with the hooks projecting into the openings 48, 48 of the mounting frames. The major portions 52, 52 of the mounting frames 46, 46 have notches 72, 72 that receive projections 74, 74 on the housing-half 14 to ensure one-way insertion of the leaf springs 42 and 44 into the housing-half. See FIGS. 1 and 2.

The ink supply and take-up spools 24 and 32 are inserted laterally relative to their axes of rotation 30 and 38 into the chambers 16 and 18 as shown in FIG. 1, which causes their hub ends 26 and 34 to depress the spring fingers 50, 50 at least partially into the openings 48, 48 of the mounting frames 46, 46.

The invention has been described in detail with particular reference to certain preferred embodiments thereof, but it will be understood that variations and modifications can be effected within the spirit and scope of the invention.

What is claimed is:

1. An ink ribbon cartridge comprising an ink ribbon spool having opposite hub ends and a rotation axis, a housing-half into which said spool is inserted laterally relative to said rotation axis during cartridge assembly, and a leaf spring that presses against one of said hub ends of said spool to urge said spool in one direction along said rotation axis in said housing-half, is characterized in that:

said leaf spring has a mounting frame and a flat spring finger that longitudinally extends from said mounting frame, beginning at an opening in said mounting frame, and at an acute angle from said opening, wherein said flat spring finger depressed at least partially into said opening by said one hub end when said spool is laterally inserted into said housing-half, whereby said flat spring finger will urge said spool in one direction along said rotation axis.

2. An ink ribbon cartridge as recited in claim 1, wherein said acute angle is less than 45°.

3. An ink ribbon cartridge as recited in claim 2, wherein said acute angle is 12.4°.

4. An ink ribbon cartridge as recited in claim 1, wherein said mounting frame has a rectangular shape to similarly shape said opening.

5. An ink ribbon cartridge as recited in claim 1, wherein said mounting frame has a major portion and a minor portion which is bent from said major portion, and said flat spring finger longitudinally extends from said minor portion to project from said opening, wherein said flat spring finger comprises, at least in part, material from the major portion removed to form the opening.

6. An ink ribbon cartridge as recited in claim 1, wherein said mounting frame is supported erect in said housing-half with said flat spring finger pointing at said acute angle into said housing-half.

7. An ink ribbon cartridge as recited in claim 6, wherein said housing-half has a hook that projects into said opening to engage said mounting frame in order to secure said mounting frame in said housing-half.

8. An ink ribbon cartridge as recited in claim 1, wherein said flat spring finger is tapered away from said mounting frame.

9. An ink ribbon cartridge comprising a cartridge housing, an ink ribbon spool in said cartridge housing which has opposite hub ends and a rotation axis, and a leaf spring in said cartridge housing which presses against one of said hub ends of said spool to urge said spool in one direction along said rotation axis in said cartridge housing, is characterized in that:

said leaf spring has a mounting frame and a flat spring finger that longitudinally extends from said mounting frame, beginning at an opening in said mounting frame, and at an acute angle from said opening; and said one hub end of said spool depresses said flat spring finger at least partially into said opening, whereby said flat spring finger urges said spool in one direction along said rotation axis.

10. A method of assembling an ink ribbon cartridge, comprising:

inserting a leaf spring having a mounting frame and a flat spring finger that longitudinally extends from the mounting frame, beginning at an opening in the mounting frame, and at an acute angle from the opening, into a housing-half to position said flat spring finger pointing at the acute angle into the housing-half; and inserting an ink ribbon spool having opposite hub ends and a rotation axis into the housing-half, laterally relative to the rotation axis, to cause one of the hub ends to depress said flat spring finger at least partially into the opening, whereby said flat spring finger will urge the spool in one direction along the rotation axis.

11. A method as recited in claim 10, wherein when the leaf spring is inserted into the housing-half the mounting frame is flexed over a ramped surface of a hook on the housing-half and the hook is then received in the opening to secure the mounting frame in the housing-half.

* * * * *

UNITED STATES PATENT AND TRADEMARK OFFICE

CERTIFICATE OF CORRECTION

PATENT NO. : 6,910,656 B2
DATED : June 28, 2005
INVENTOR(S) : Paul A. Lysiak et al.

It is certified that error appears in the above-identified patent and that said Letters Patent is hereby corrected as shown below:

Column 3,
Line 58, replace “finger depressed” with -- finger is depressed --.

Signed and Sealed this

First Day of November, 2005

JON W. DUDAS
*Director of the United States Patent and Trademark Office*